US006105656A

United States Patent [19]

Hernandez et al.

[11] Patent Number: 6,105,656

[45] Date of Patent: Aug. 22, 2000

[54] CARRIER ASSEMBLY FOR VERTICAL BLINDS

[75] Inventors: Osvaldo Hernandez, 3505 S. Ocean Dr. Suite 915, Hollywood, Calif. 33019; Luis Fernando Gomez, Miramar, Fla.

[73] Assignee: Osvaldo Hernandez, Miami, Fla.

[21] Appl. No.: 09/411,100

[22] Filed: Oct. 4, 1999

[51] Int. Cl.[7] ..... E06B 9/30

[52] U.S. Cl. ..... 160/168.1 V; 160/174 V; 160/176.1 V; 160/177 V

[58] Field of Search ..... 160/167 V, 168.1 V, 160/174 V, 176.1 V, 177 V, 178.1 V, 178.3 R; 74/411, 422

[56] References Cited

U.S. PATENT DOCUMENTS

| | | | |
|---|---|---|---|
| 4,335,775 | 6/1982 | Frentzel et al. | 160/176.1 V X |
| 5,056,578 | 10/1991 | Helver | 160/177 V |
| 5,249,617 | 10/1993 | Durig | 160/168.1 V |
| 5,407,008 | 4/1995 | Boloix | 160/177 V |
| 5,501,116 | 3/1996 | Weng | 160/174 V X |
| 5,626,177 | 5/1997 | Colson et al. | 160/167 V X |
| 5,924,467 | 7/1999 | Allsopp | 160/177 V |
| 6,000,456 | 12/1999 | Neverett | 160/177 V X |

FOREIGN PATENT DOCUMENTS

| | | | |
|---|---|---|---|
| 8200874 | 10/1983 | Netherlands | 160/167 |

*Primary Examiner*—Bruce A. Lev

[57] ABSTRACT

A carrier assembly comprises a housing having an aperture formed substantially centrally thereon for accepting a splined tilt rod. The tilt rod interconnects a plurality of carrier assemblies which form a vertical blind assembly. The splined tilt rod permits uniform rotation of a linear gear member contained within the carrier assembly to interact with a gear-headed slat support which may be removably connected to the housing. The interaction permits a slat depending from each of the plurality of carrier assemblies of the vertical blind assembly to rotate synchronously. Additionally, the gear-headed slat support is provided with a flush mounted stopping member for engaging the terminus of either end of the linear gear member to prevent skipping of the slats when said slats are fully opened or fully closed.

11 Claims, 5 Drawing Sheets

CARRIER ASSEMBLY FOR VERTICAL BLINDS

FIELD OF THE INVENTION

The present invention relates to a carrier assembly for vertical blinds. More particularly, the carrier assembly comprises, in part, an automatic stopping mechanism to prevent skipping of gears to retain proper alignment of the slats depending from the assembly.

BACKGROUND OF THE INVENTION

Vertical blind assemblies are well know in the art of window treatments. Such assemblies typically include a number of vertically depending slats or blinds, each of which is rotatably mounted on a carrier assembly. The assembly permits the blinds to positioned uniformly "open" or "closed," or in uniform positions therebetween. In addition, the blinds move horizontally as a single grouping along a supporting header. The uniform positioning is effectuated by means of a splined tilt rod that extends the horizontal length of header, interconnecting each of the carrier assemblies. The splined tilt rod works in conjunction with gears located within the carrier assembly to permit the uniform rotation of the blinds as hereinabove described.

A common problem associated with the use of vertical blinds is the tendency of individual slats to skip their gear mechanisms which result in misaligned slats. The problem occurs when an operator of the blind assemblies exerts to much torque on the tilt rod. Attempts at resolving this skipping problem have been made. In particular, the patent to Helver, U.S. Pat. No. 5,056,578, discusses a carrier structure for a vertical blind assembly utilizing a "clutch" mechanism to retain uniformity of the vertical slats. As an alternative embodiment, Helver discusses the use of an finger extending beyond the longitudinal axis of a first gear which engages with one of two stop member built onto the carrier assembly. While this device may achieve its intended purpose, the use of a clutch mechanism requires more components than needed to maintain uniform alignment, which increases the carrier assembly's cost and assembly time. Alternatively, the extended finger concept is subject to breakage as it extends over the axis of the identified first gear. Additionally, the need to build stops onto the carrier assembly increases the costs of the said assembly.

In order to overcome the problems aforementioned in the prior art, it would be beneficial to create a carrier assembly stopping mechanism to promote uniformity in vertical slat orientation that does not require multiple components, is not subject to breakage, and does not require unnecessary, extraneous build up of members onto a carrier assembly housing.

SUMMARY OF THE INVENTION

The present invention overcomes the disadvantages of the prior art. A carrier assembly comprises a housing having an aperture formed substantially centrally thereon for accepting a splined tilt rod. The tilt rod interconnects a plurality of carrier assemblies which form a vertical blind assembly. The splined tilt rod permits uniform rotation of a linear gear member contained within the carrier assembly to interact with a gear-headed slat support which may be removably connected to the housing. The interaction permits a slat depending from each of the plurality of carrier assemblies of the vertical blind assembly to rotate synchronously. Additionally, the gear-headed slat support is provided with a flush mounted stopping member for engaging the terminus of either end of the linear gear member to prevent skipping of the slats when said slats are fully opened or fully closed.

It is thus an object of the present invention to provide a carrier assembly for vertical blinds.

It is another object of the present invention to provide a carrier assembly which prevents skipping of gears to promote uniformity of slat rotation of a vertical blind assembly.

It is still another object of the present invention to provide a stopping member that is flush mounted with the slat support base of a carrier assembly.

It is still yet another object of the present invention to utilize a linear gear member of a carrier assembly to prevent skipping of gears and effectuate uniformity of slat rotation of a vertical blind assembly.

It is still yet another object of the present invention to provide a vertical blind assembly that incorporates a stopping member flush mounted onto a slat support base of each of a plurality of carrier assemblies to promote uniformity of slat rotation without gear skipping.

BRIEF DESCRIPTION OF THE DRAWINGS

Other objects and advantages of the present invention will be better understood by viewing the depictions of the features embodying the invention as shown in the accompanying drawing, forming a part of this application, in which.

DETAILED DESCRIPTION OF THE PREFERRED EMBODIMENT OF THE INVENTION

Figure 1:
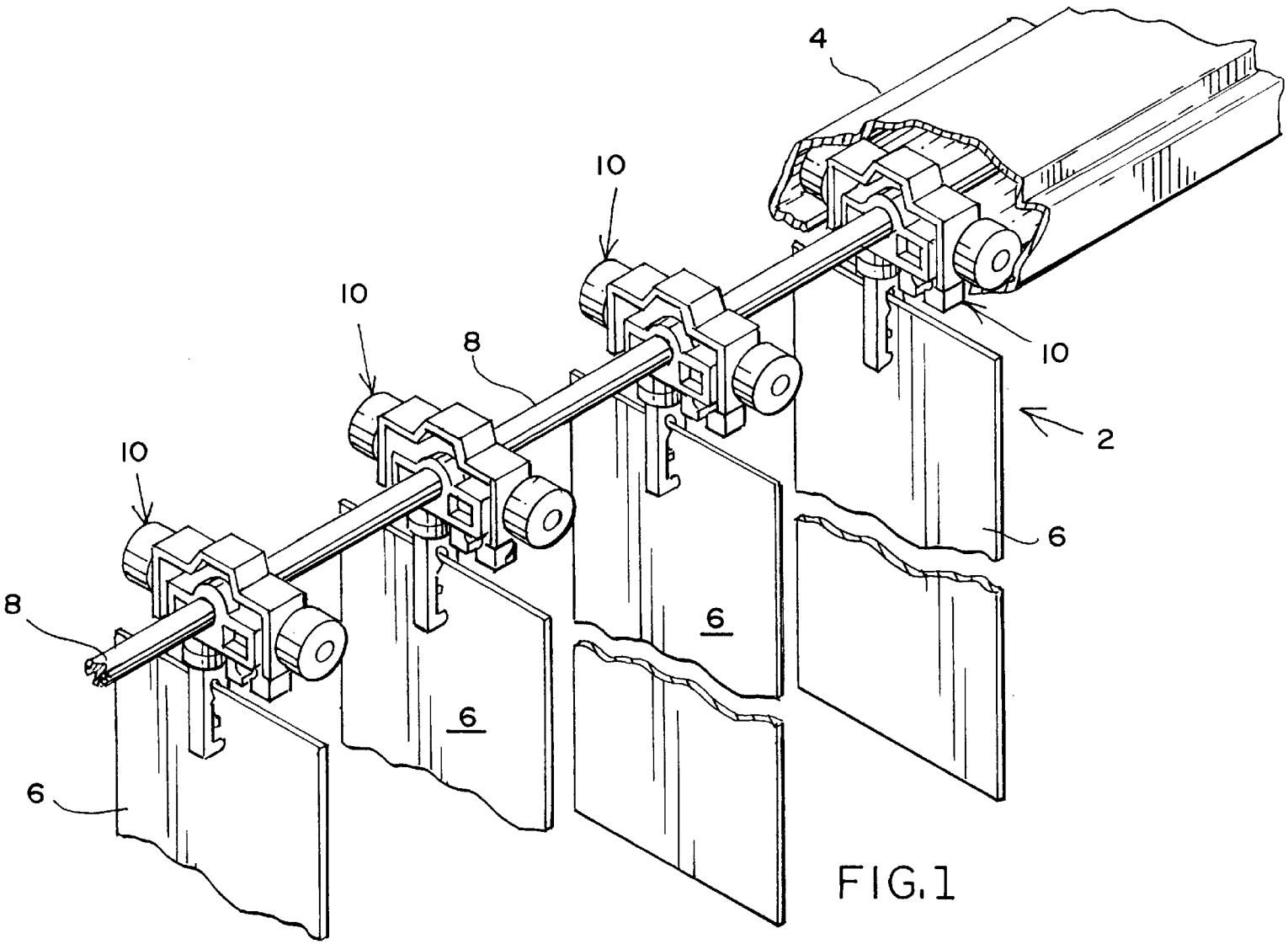
FIG. 1 is a perspective view of a vertical blind assembly incorporating the present carrier assembly invention.
Figure 3:
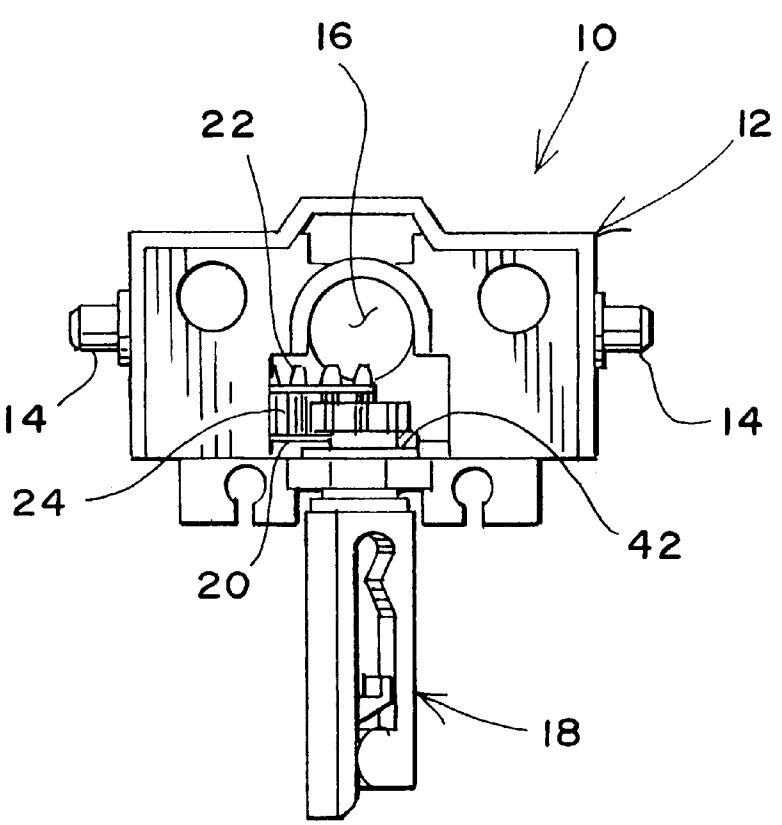
FIG. 3 is a front view of a carrier assembly of the present invention depicting a right-most position of rotation.
Figure 2:
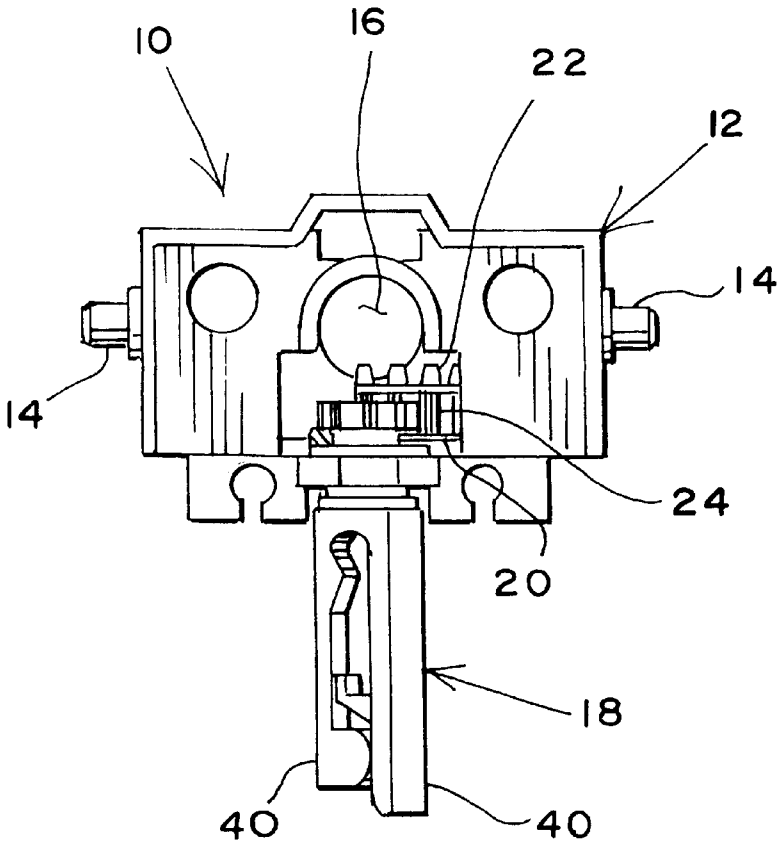
FIG. 2 is a front view of a carrier assembly of the present invention depicting a left-most position of rotation.
Figure 5:
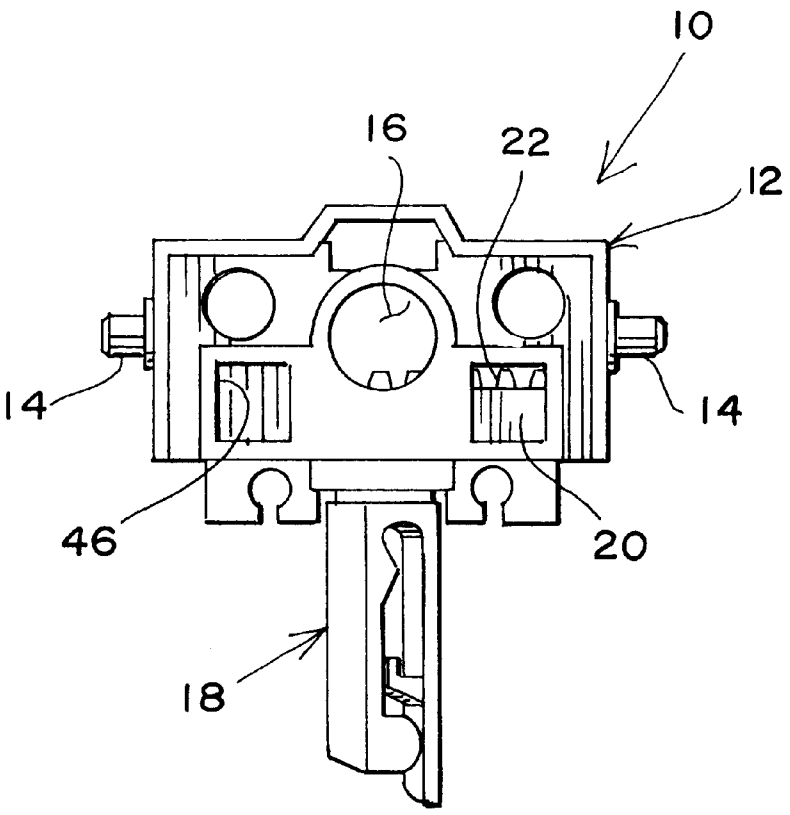
FIG. 5 is a rear view of a carrier assembly of the present invention depicting a right-most position of rotation.
Figure 4:
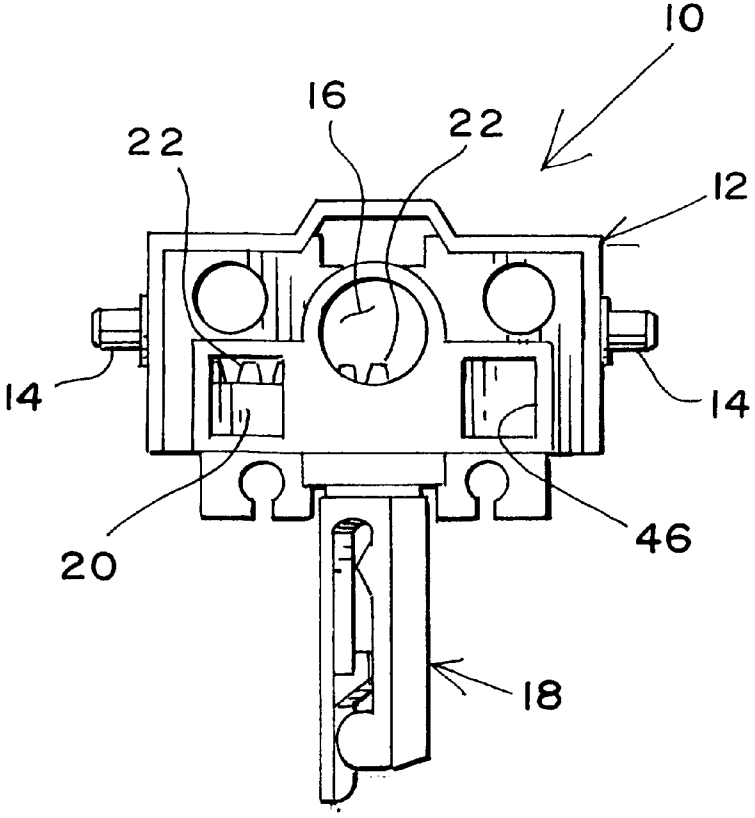
FIG. 4 is a rear view of a carrier assembly of the present invention depicting a left-most position of rotation.

Referring to FIG. 1, a vertical blind assembly 2 generally comprises a header 4 and a plurality of blinds or slats 6 interconnected by a splined tilt rod 8 to a plurality of carrier assemblies 10. One slat 6 each depends from one carrier assembly 10 of the vertical blind assembly 2.

Referring to FIGS. 2–5, the carrier assembly 10 is shown in greater detail. The carrier assembly 10 comprises a generally one-piece housing 12. The housing 12 is typically an injection molded plastic member. Opposed ends of the housing 12 terminate in axes 14 for holding rollers (not shown) which permit travel of the carrier 10 along the length of the header 4. The housing 12 has an aperture 16 substantially centrally located thereon to permit the rod 8 to pass transversely therethrough. The tilt rod 8 may be rotated about its axis which causes rotation of a depending slat support 18 to which the upper end of a slat 6 is connectable.

Figure 7:
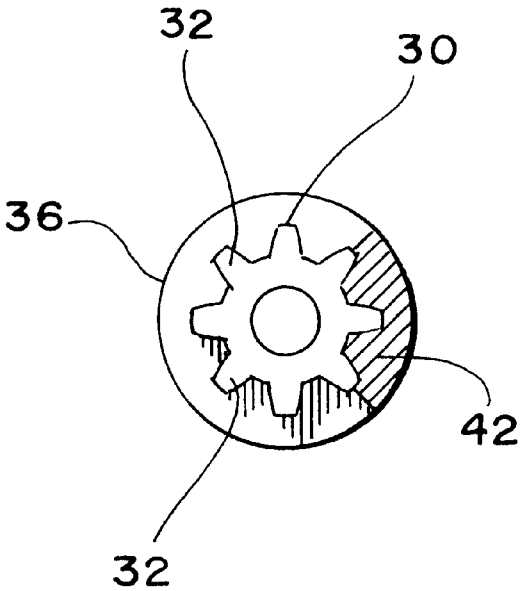
FIG. 7 is a top plan view of the slat support member shown in FIG. 6.
Figure 6:
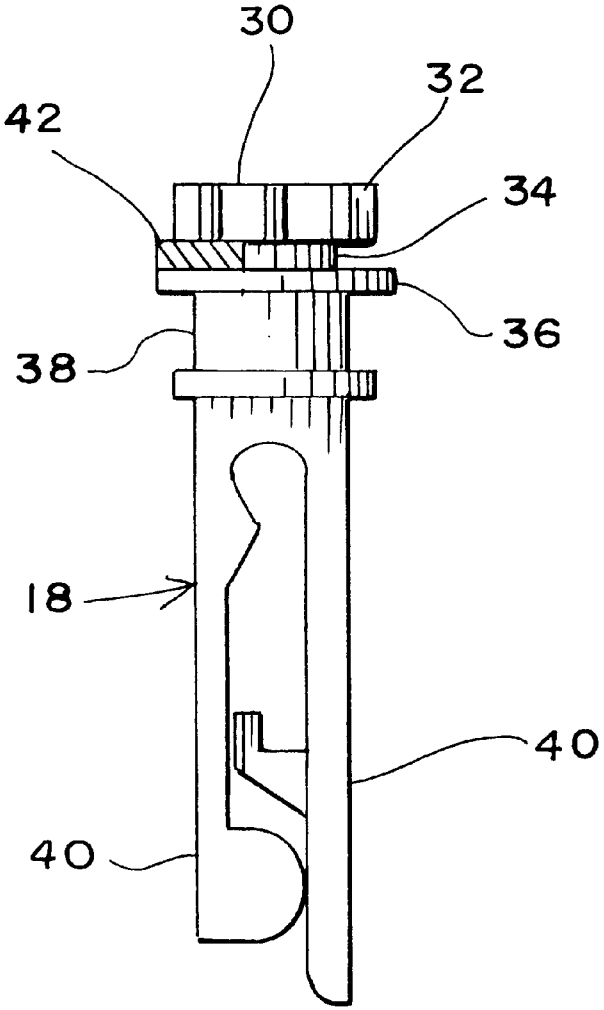
FIG. 6 is a side view of the slat support member of a carrier assembly of the present invention.

The carrier assembly 10 comprises two gear means for driving the rotation of the slat support 18. A first gear means is comprised of a generally linear gear 20 having both longitudinally upstanding disposed, spaced-apart gear teeth 22 and laterally disposed, spaced-apart gear teeth 24. Gear 20 is a one piece member and may be made of injection molded plastic. The second gear means is comprised of a generally round gear 30 having radially disposed, spaced-apart teeth 32. The gear 30 is integral with the slat support 18 and forms its top and is best viewed in FIGS. 6 and 7. Immediately adjacent the gear 30 of slat support 18 is neck 34 which terminates in a base 36. Base 36 forms one wall of a channel 38 which channel 38 removably and rotatably interconnects the support 18 with housing 12. The slat support 18 terminates at its end opposite gear 30 with fingers 40 for clutching a slat.

Furthermore, slat support 18 comprises a stop member 42 located on base 36 and connected to neck 34. The stop member 42 is a built up plastic component, when the slat support 18 is manufactured by injection molding means, yet its height does not reach or impede the teeth 32 of gear 30. The stop 42 is flush molded onto the base 36 and thus shares its radius. It is preferred that the stop member 42 incorporate a coverage of base 36 of not more than 135 degrees, and preferably 94 degrees. When slat support 18 is injection molded, the entire support can be a one piece device including all of its above described components.

Figure 9:
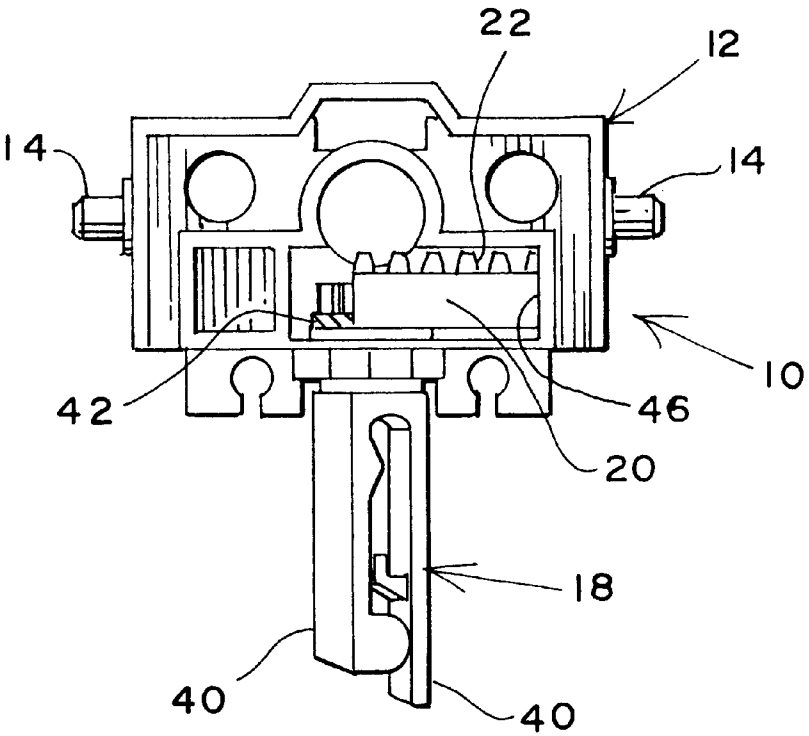
FIG. 9 is a detail rear view of a carrier assembly of the present invention depicting a right-most position of rotation.
Figure 8:
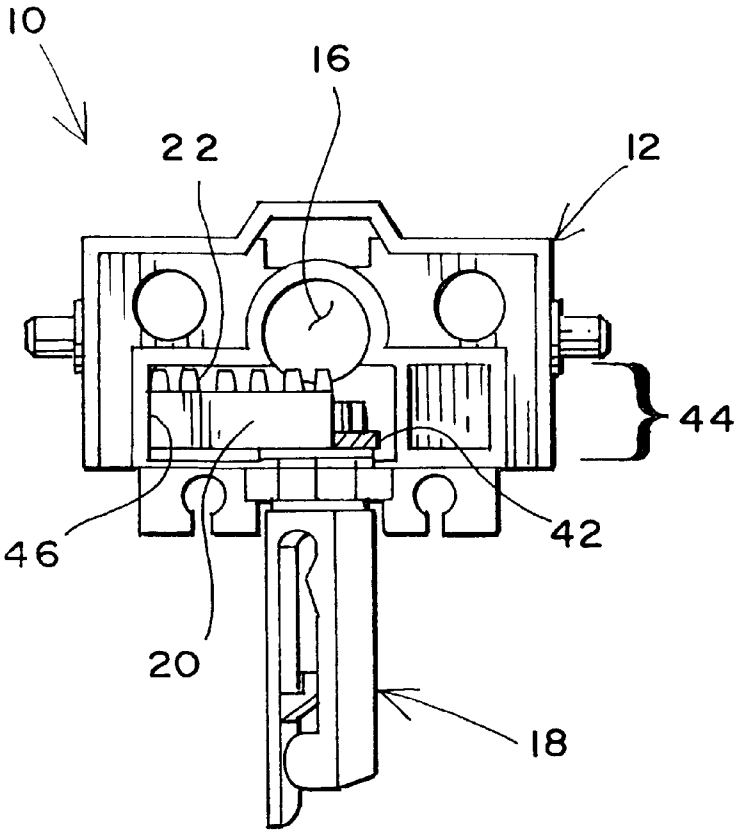
FIG. 8 is a detail rear view of a carrier assembly of the present invention depicting a left-most position of rotation.

In FIGS. 8 and 9, detail of gear 20 is shown with respect to housing 12. Housing 12 further comprises a linear track 44 onto which gear 20 is placed. Gear 20 moves linearly along track 44 upon rotation of the splined tilt rod 8 whose teeth spaces engage the upstanding longitudinal teeth 22 of gear 20. The movement of linear gear 20 in this fashion causes the round gear 30 to simultaneously rotate as the lateral teeth 24 of gear 20 engage with the spaces between the teeth 32 of gear 30. When rotation to the left-most position (FIG. 8) or the right-most position (FIG. 9) of gear 20 is reached, stop member 42 comes into direct contact with and urges the respective end of gear 20 against the track wall 46 which prevents further movement of the gears 20 and 30. Thus, gear skipping is eliminated. With gear skipping eliminated, slats 6 of the vertical blind assembly 2 will always be in a proper, uniform alignment.

It is intended that the description of the preferred embodiment of this invention is illustrative only. Other embodiments of the invention that are within the scope and concept of this invention are herein included within this application.

What is claimed is:

1. A slat support for a carrier housing of a vertical blind assembly, said slat support comprising a top end having a generally round gear with radially disposed spaced-apart teeth, said gear being connected to a neck which terminates in a base such that said base forms one wall of a channel which is adapted to be removably and rotatably interconnects said support with said housing, said slat support having a bottom end adjacent to said channel comprising slat-clutching fingers, and a stop member located on said base such that said stop is mounted flush onto said base and radially extends a distance from said neck equal to said base, and wherein said stop radially extends a distance from said neck greater than said gear teeth.

2. A slat support of claim 1 which is manufactured of plastic.

3. A slat support of claim 1 which is injection molded.

4. A slat support of claim 3 wherein said stop member is comprised of a build up of injection molded plastic onto said base and about said neck such that the height of said stop does not impede the teeth of said round gear.

5. A slat support of claim 1 wherein said stop covers an area between zero and 135 degrees of said base.

6. A slat support of claim 5 wherein said stop covers an area between 80 and 110 degrees of said base.

7. A slat support of claim 5 wherein said stop covers an area that is 94 degrees of said base.

8. A carrier assembly for a vertical blind assembly, said carrier assembly comprising a one-piece housing having an aperture substantially centrally located thereon to permit a splined tilt rod to pass transversely therethrough, a generally linear gear having longitudinally upstanding disposed, spaced-apart gear teeth and laterally disposed, spaced-apart gear teeth, a slat support comprising a top end having a generally round gear with radially disposed spaced-apart teeth, said gear being connected to a neck which terminates in a base such that said base forms one wall of a channel which removably and rotatably interconnects said support with said housing, said slat support having a bottom end adjacent to said channel comprising slat-clutching fingers, and a stop member located on said base such that said stop is mounted flush onto said base and radially extends a distance from said neck equal to said base, and wherein said stop radially extends a distance from said neck greater than said gear teeth, and a linear track formed on said housing onto which said linear gear is guided linearly along said track upon rotation of said tilt rod whose teeth spaces engage the upstanding longitudinally disposed teeth of said linear gear and whose laterally disposed teeth engage and activate said round gear to simultaneously rotate said gear such that when rotation to the left-most position or the right-most position of said linear gear is reached, said stop member comes into direct contact with the respective end of said gear and urges it against a wall of the said track to prevent further movement of said linear and round gears.

9. A carrier assembly of claim 8 wherein said housing is manufactured of injection molded plastic.

10. A carrier assembly of claim 8 wherein said housing has opposed ends which terminate in axes to facilitate horizontal movement along said vertical blind assembly.

11. A vertical blind assembly comprising a header, a plurality of slats interconnected by a transversely mounted splined tilt rod, and a plurality of carrier assemblies such that one said slat depends vertically from each said carrier assembly, said carrier assembly further comprising a one-piece housing having an aperture substantially centrally located thereon to permit said tilt rod to pass therethrough, a generally linear gear having longitudinally upstanding disposed, spaced-apart gear teeth and laterally disposed, spaced-apart gear teeth, a slat support comprising a top end having a generally round gear with radially disposed spaced-apart teeth, said gear being connected to a neck which terminates in a base such that said base forms one wall of a channel which removably and rotatably interconnects said support with said housing, said slat support having a bottom end adjacent to said channel comprising slat-clutching fingers, and a stop member located on said base such that said stop is mounted flush onto said base and radially extends a distance from said neck equal to said base, and wherein said stop radially extends a distance from said neck greater than said gear teeth, and a linear track formed on said housing onto which said linear gear is guided linearly along said track upon rotation of said tilt rod whose teeth spaces engage the upstanding longitudinally disposed teeth of said linear gear and whose laterally disposed teeth engage and activate said round gear to simultaneously rotate said gear such that when rotation to the left-most position or the right-most position of said linear gear is reached, said stop member comes into direct contact with the respective end of said gear and urges it against a wall of the said track to prevent further movement of said linear and round gears.

* * * * *